US012384612B2

(12) United States Patent
Miura et al.

(10) Patent No.: US 12,384,612 B2
(45) Date of Patent: Aug. 12, 2025

(54) MICROWAVABLE POUCH

(71) Applicant: Toyo Seikan Co., Ltd., Tokyo (JP)

(72) Inventors: Takashi Miura, Yokohama (JP); Shie Matsunaga, Yokohama (JP); Reina Tokairin, Yokohama (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 200 days.

(21) Appl. No.: 18/207,813

(22) Filed: Jun. 9, 2023

(65) Prior Publication Data

US 2023/0312211 A1 Oct. 5, 2023

Related U.S. Application Data

(63) Continuation of application No. PCT/JP2021/041822, filed on Nov. 15, 2021.

(30) Foreign Application Priority Data

Dec. 14, 2020 (JP) ..... 2020-206425

(51) Int. Cl.
*B65D 77/22* (2006.01)
*B65D 81/34* (2006.01)

(52) U.S. Cl.
CPC ..... *B65D 77/225* (2013.01); *B65D 81/3461* (2013.01); *B65D 2205/00* (2013.01); *B65D 2581/3437* (2013.01)

(58) Field of Classification Search
CPC ..... B65D 77/225; B65D 81/3461; B65D 2205/00; B65D 2581/3437
USPC ..... 383/103
See application file for complete search history.

(56) References Cited

U.S. PATENT DOCUMENTS

2014/0363104 A1 12/2014 Kondo et al.
2016/0272402 A1 9/2016 Kondo et al.
2019/0135521 A1* 5/2019 Miura ..... B65D 81/3461

FOREIGN PATENT DOCUMENTS

CN 104144859 A 11/2014
JP 2005324846 A * 11/2005 ..... A23L 5/15
JP 4029590 B2 1/2008
JP 2013-256323 A 12/2013
JP 2017057008 A * 3/2017
(Continued)

OTHER PUBLICATIONS

Machine translation of JP-2020083320-A (Year: 2020).*
(Continued)

*Primary Examiner* — Jes F Pascua
(74) *Attorney, Agent, or Firm* — WHDA, LLP

(57) ABSTRACT

Provided is a microwavable pouch having a rectangular outer shape in plan view. The microwavable punch includes an automatic steam release mechanism. The automatic steam release mechanism includes a steam release portion and a steam release seal portion surrounding the steam release portion, and assuming that there is an inscribed ellipse in contact with centers of inner edges of sides of a peripheral seal portion of the pouch, the steam release seal portion is formed so that a circumference of the inscribed ellipse is positioned in a width region of a seal separation start portion of the steam release seal portion closest to a center point of an accommodation portion or in a vicinity of the seal separation start portion.

4 Claims, 7 Drawing Sheets

(56) References Cited

FOREIGN PATENT DOCUMENTS

| | | | | |
|---|---|---|---|---|
| JP | 2019-116330 | A | | 7/2019 |
| JP | 2019-151343 | A | | 9/2019 |
| JP | 2020-83320 | A | | 6/2020 |
| JP | 2020083320 | A | * | 6/2020 |

OTHER PUBLICATIONS

International Search Report dated Feb. 1, 2022, issued in counterpart International Application No. PCT/JP2021/041822. (2 pages).
Written Opinion of the International Searching Authority (Form PCT/ISA/237) dated Feb. 1, 2022, issued in counterpart International Application No. PCT/JP2021/041822. (3 pages).

* cited by examiner

MICROWAVABLE POUCH

TECHNICAL FIELD

The disclosure relates to a microwavable pouch that is formed into a bag shape by thermally bonding overlapping laminated films, and includes an automatic steam release mechanism that automatically releases steam from the pouch during heating.

BACKGROUND

Packaged food products are commercially available in which cooked or semi-cooked food is accommodated in a pouch formed into a bag shape by thermally bonding overlapping laminated films, and the food is then cooked in a microwave oven before eating.

Such microwavable pouches are commonly provided with an automatic steam release mechanism that automatically releases the steam inside the pouch during heating.

As the automatic steam release mechanism, one mechanism is known in which overlapping laminated films are partially thermally bonded to form a steam release seal portion having an annular shape, and steam is released when part of the steam release seal portion separates and retracts.

In such an automatic steam release mechanism, the position of the steam release seal portion affects how easily the steam is released during heating in a microwave oven and the deformation of the pouch after being filled. When a peripheral seal portion largely retracts during heating, the bag may tear from the peripheral seal portion. Furthermore, significant deformation of the pouch after being filled adversely affects factors such as ability to convey the pouch in a filling facility, inserting the pouch into a box, and the external appearance of the pouch.

In the example described in JP 4029590 B, the steam release seal portion is formed such that the initial breaking point of the steam release seal portion closest to the center point of a pouch accommodation portion is positioned on or inward of the circumference of an inscribed circle in contact with the centers of inner edges of the peripheral seal portion on two short sides.

SUMMARY

Unfortunately, the following has been found regarding the steam release seal portion provided as in JP 4029590 B. Specifically, an excessively large distance between the position of the initial breaking point of the steam release seal portion and the center point of the pouch accommodation portion renders steam ventilation difficult and causes the peripheral seal portion to retract. On the other hand, an excessively short distance between the position of the initial breaking point of the steam release seal portion and the center point of the pouch accommodation portion facilitates steam ventilation but results in large deformation of the pouch after being filled.

The disclosure has been made to solve the above-mentioned problem, and an object of the disclosure is to provide a microwavable pouch that facilitates steam release during heating, and may prevent deformation of a portion including an automatic steam release mechanism after the pouch is filled.

A microwavable pouch of the disclosure is a microwavable pouch having a rectangular outer shape in plan view, and including an automatic steam release mechanism, and achieves the above object with a configuration in which the automatic steam release mechanism includes a steam release portion and a steam release seal portion surrounding the steam release portion, and, assuming that there is an inscribed ellipse in contact with centers of inner edges of sides of a peripheral seal portion of the pouch, the steam release seal portion is formed so that a circumference of the inscribed ellipse is positioned in a width region of a seal separation start portion of the steam release seal portion closest to a center point of an accommodation portion or in a vicinity of the seal separation start portion.

According to claim 1 of the disclosure, the steam release seal portion is formed so that the circumference of the inscribed ellipse in contact with the centers of the inner edges of the sides of the peripheral seal portion of the pouch is positioned in the width region of the seal separation start portion of the steam release seal portion closest to the center point of the accommodation portion or in the vicinity of the seal separation start portion. With this configuration, steam can be ventilated when the steam release seal portion separates and retracts, without the peripheral seal portion being separated due to the force of internal pressure spreading from the center point side of the accommodation portion, while suppressing deformation of the automatic steam release mechanism, such as warpage of the steam release seal portion, due to the pressure of the content after the pouch is filled.

According to claim 2 of the disclosure, the steam release seal portion is formed with an initial breaking point, which is an outer edge of the seal separation start portion of the steam release seal portion, being in contact with the circumference of the inscribed ellipse. With this configuration, the initial breaking point can be located as close as possible to the center point of the accommodation portion, whereby steam release performance can be further improved.

According to claim 3 of the disclosure, the steam release seal portion has a seal strength that is equal to a seal strength of the peripheral seal portion. With this configuration, the steam release seal portion more easily separates than the peripheral seal portion while having required seal strength. Thus, the peripheral seal portion can be reliably prevented from separating before the seal separation start portion of the steam release seal portion separates and retracts.

According to claim 4 of the disclosure, the steam release seal portion is provided continuous with the peripheral seal portion. With this configuration, warpage of the steam release seal portion after the content filling can be reliably prevented.

DESCRIPTION OF EMBODIMENTS

A microwavable pouch of the disclosure is formed into a bag shape by heat-sealing stacked laminated films, and includes an automatic steam release mechanism that automatically releases steam inside the pouch to the outside during heating.

As the laminated film, any film may be used as long as it is formed by, for example, stacking known synthetic resin films such as a synthetic resin film made of a thermoplastic resin, such as polyester, polypropylene, or polyamide, or a coating film or vapor-deposited film obtained by imparting a gas barrier property or a moisture barrier property to the synthetic resin film, or stacking a paper- or metal-containing layer and the synthetic resin film.

A microwavable pouch according to the disclosure will be described below with reference to the drawings.

First Embodiment

Figure 1:
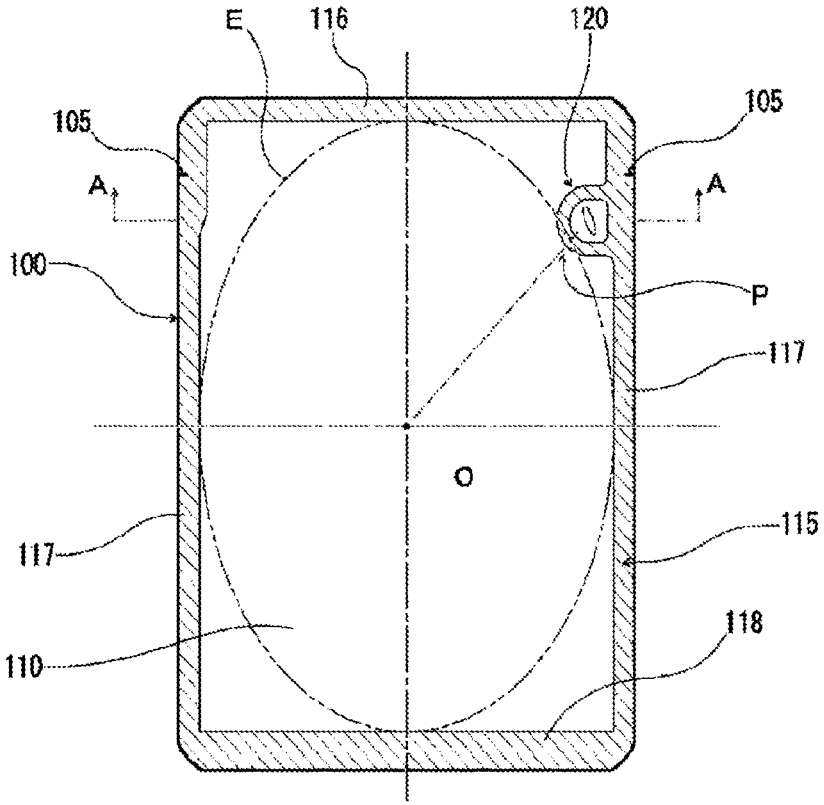
FIG. 1 is a plan view illustrating an example of a configuration of a microwavable pouch according to a first embodiment of the disclosure.
Figure 2:
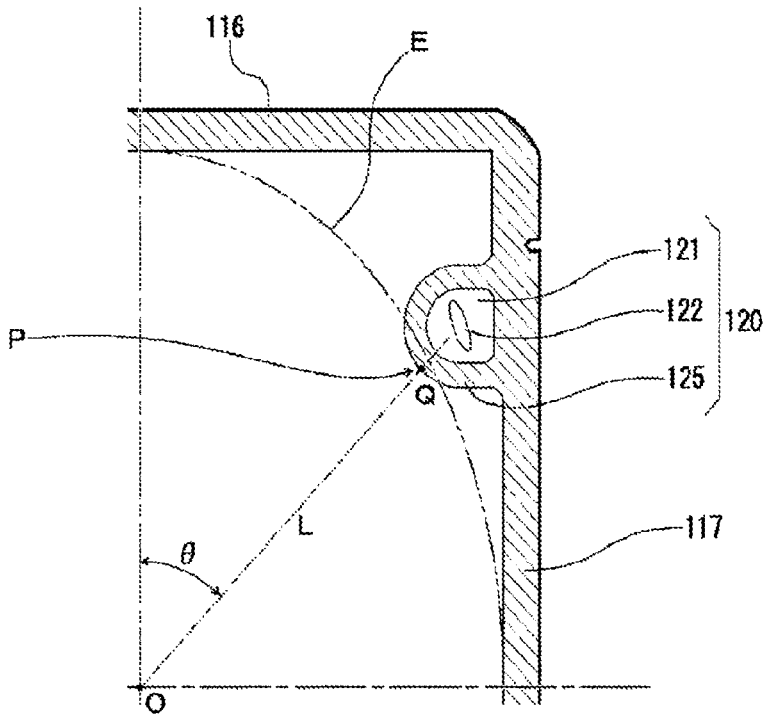
FIG. 2 is an enlarged view illustrating part of the microwavable pouch illustrated in FIG. 1.
Figure 3:
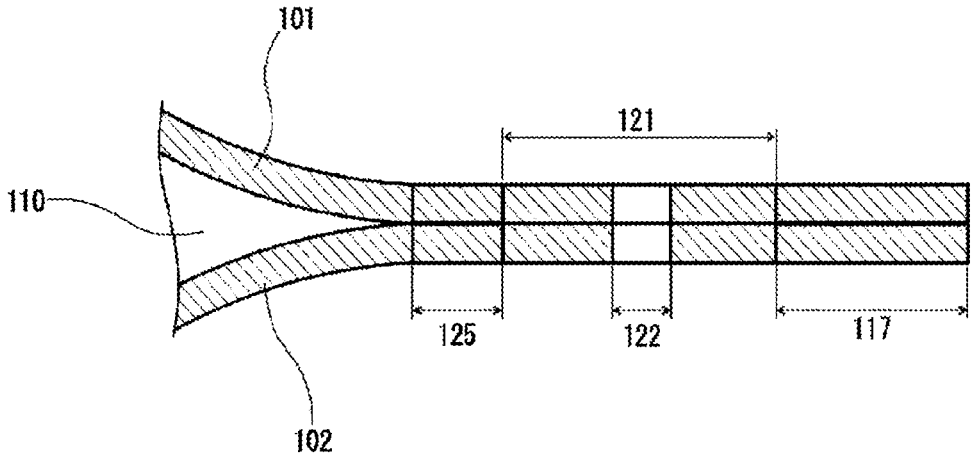
FIG. 3 is a cross-sectional view schematically illustrating part of a configuration of a cross section taken along line A-A in FIG. 1.

As illustrated in FIGS. 1 to 3, a microwavable pouch (hereinafter, simply referred to as "pouch") 100 according to a first embodiment of the disclosure is configured as a flat pouch having, for example, a rectangular outer shape in plan view.

The pouch 100 is formed into a bag shape by thermally bonding peripheral edges of a front surface side film 101 and a rear surface side film 102, which are overlapped with each other as a pair, to form a peripheral seal portion 115. The four sides of the peripheral seal portion 115 define an accommodation portion 110 in which content such as food is accommodated.

The peripheral seal portion 115 includes a top seal portion 118 formed by thermally bonding upper edges of the front surface side film 101 and the rear surface side film 102, side seal portions 117 formed by thermally bonding both left and right side edges of the front surface side film 101 and the rear surface side film 102, and a bottom seal portion 118 formed by thermally bonding lower edges of the front surface side film 101 and the rear surface side film 102.

A notch 105 is provided at an intended opening position of the peripheral seal portion 115 so that the pouch 100 can be easily opened after heating.

The pouch 100 includes an automatic steam release mechanism 120 that automatically releases steam inside the accommodation portion 110 to the outside during heating.

The automatic steam release mechanism 120 includes a steam release portion 121 and a steam release seal portion 125 surrounding the steam release portion 121 and isolating the steam release portion 121 from the accommodation portion 110.

The steam release portion 121 is formed, for example, as an unsealed portion at which the front surface side film 101 and the rear surface side film 102 are not thermally bonded.

The specific mode of the steam release portion 121 is not limited thereto and, for example, the steam release portion 121 may be formed as a weakly bonded portion at which thermal bonding is performed in a manner to achieve a lower seal strength than that of the peripheral seal portion 115 and the steam release seal portion 125, or as a patterned bonded portion where a knurled seal or the like is applied to the pair of laminated films.

The steam release portion 121 includes a steam exit portion 122 formed as a hole or a slit. The steam exit portion 122 is formed as, for example, a through hole having a flat elliptical opening shape so as to extend obliquely relative to the pouch side edge. The steam exit portion 122 does not need to be formed through both the front surface side film 101 and the rear surface side film 102, and may be formed in only one of the front surface side film 101 and the rear surface side film 102.

The steam release seal portion 125 is formed by thermally bonding the front surface side film 101 and the rear surface side film 102, and is configured to separate and retract as the pressure inside the accommodation portion 110 rises during heating. A seal separation start portion P where separation starts due to steam generated in the pouch 100 is a portion of the outer edge of the steam release seal portion 125 closest to a center point O of the accommodation portion 110. An outer edge of the seal separation start portion P is an initial breaking point Q.

The steam release seal portion 125 is formed to have, for example, a semi-annular shape in plan view, with both ends being continuous with one side seal portion 117. Further, the steam release seal portion 115 may be provided continuous with the top seal portion 116, or may be provided separated from the peripheral seal portion 115.

In the present embodiment, the steam release portion 121 is described as being formed as an unsealed portion. However, in a case of a pouch having no unsealed portion, the steam release portion 121 is a portion of the steam exit portion 122 closest to the center point O of the accommodation portion 110.

In the pouch 100 of the present embodiment, assuming that there is an inscribed ellipse E in contact with center positions of the inner edges of the peripheral seal portions 115 on two short sides, that is, the top seal portion 116 and the bottom seal portion 118, and center positions of the inner edges of the peripheral seal portions 115 on two long sides, that is, the left and right side seal portions 117, 117, the steam release seal portion 125 is formed so that the circumference of the inscribed ellipse E is located within a width region of the seal separation start portion P in the vicinity of a corner portion corresponding to the four corners of the pouch 100. This inscribed ellipse E has ellipticity, which is the ratio of the minor axis to the major axis, being 0.6 to 0.97, and has a center point matching the center point O of the accommodation portion 110.

When the pouch 100 is heated, the pouch 100 expands radially from the center point O of the accommodation portion 110 toward the peripheral seal portion 115 due to steam or the like generated from the content. Since the pouch 100 has a rectangular outer shape in plan view, the space inside the accommodation portion 110 expands in a substantially ellipsoidal shape, and the force of the internal pressure spreading from the center point O side of the accommodation portion 110 acts on the surface of the accommodation portion that has expanded in a substantially ellipsoidal shape.

In the pouch 100 of the present embodiment, the steam release seal portion 125 is formed so that the circumference of the inscribed ellipse E in contact with the centers of the inner edges of the sides of the peripheral seal portion 115 of the pouch 100 is positioned in the width region of the seal separation start portion P. With this configuration, the force of the internal pressure spreading from the center point O side of the accommodation portion 110 can be effectively applied to the seal separation start portion P, so that the steam can be vented through the steam exit portion 122 with the steam release seal portion 125 separates and retracts from the seal separation start portion P, without causing the peripheral seal portion 115 to separate. In addition, since a sufficient distance L can be guaranteed between the initial breaking point Q, which is the outer edge of the seal separation start portion P of the steam release seal portion 125, and the center point O of the accommodation portion 110, deformation of the portion including the automatic steam release mechanism 120, such as warpage of the steam release seal portion 125 caused by the pressure of the contents, after filling the content can be suppressed.

The steam release seal portion 125 is preferably configured such that the initial breaking point Q, which is the outer edge of the seal separation start portion P, is in contact with the circumference of the inscribed ellipse E. With this configuration, the initial breaking point Q in the seal separation start portion P can be located as close as possible to the center point O of the accommodation portion 110 thereby further improving the steam release performance.

The steam release seal portion 125 has a seal strength equal to the seal strength of the peripheral seal portion 115 at room temperature, for example. With this configuration, the steam release seal portion 125 more easily separates than the peripheral seal portion 115 while having required seal strength. Thus, the peripheral seal portion 115 can be reliably prevented from separating before the seal separation start portion P of the steam release seal portion 125 separates and retracts.

While the microwavable pouch configured as a flat pouch is described in the first embodiment above, the microwavable pouch is not limited to this shape and may be configured as, for example, a standing pouch.

Second Embodiment

Figure 4:
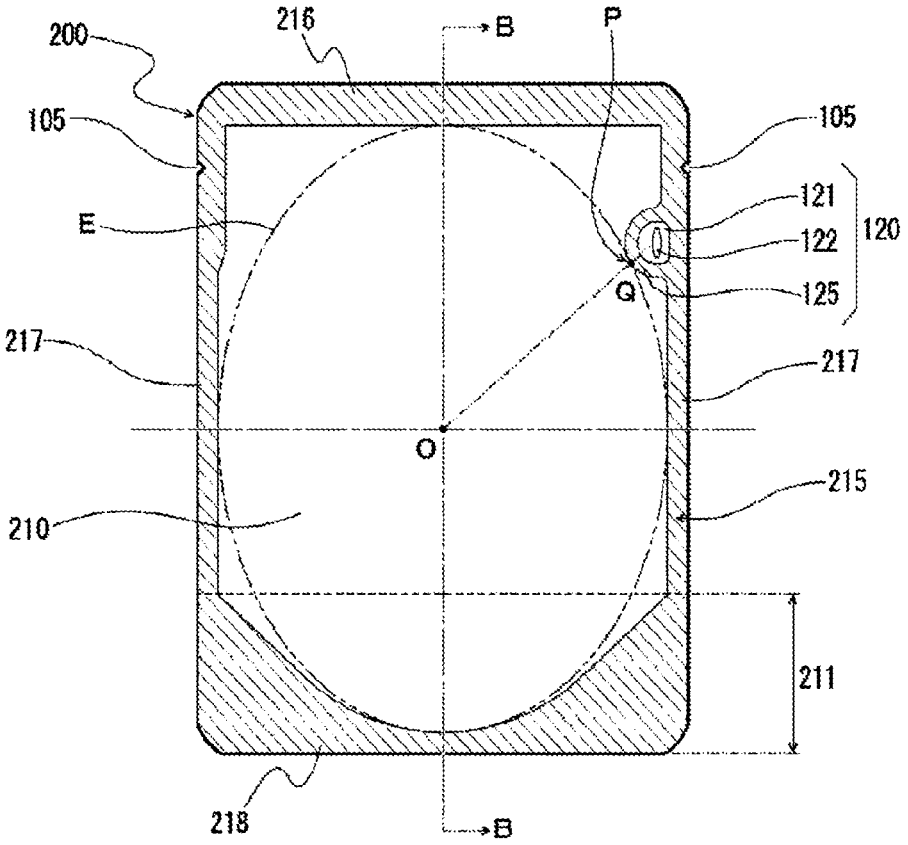
FIG. 4 is a plan view illustrating an example of a configuration of a microwavable pouch according to a second embodiment of the disclosure.
Figure 5:
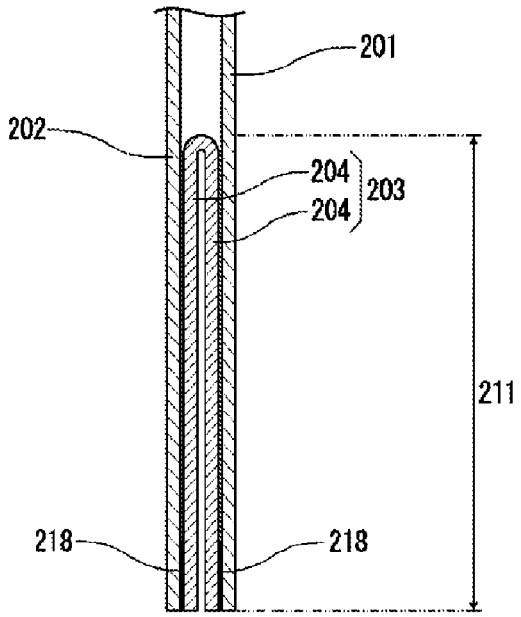
FIG. 5 is a cross-sectional view schematically illustrating part of a configuration of a cross section taken along line B-B in FIG. 4.

As illustrated in FIGS. 4 and 5, a microwavable pouch (hereinafter, simply referred to as "pouch") 200 according to a second embodiment of the disclosure is configured as a standing pouch having a rectangular outer shape in plan view, and having a gusset portion 211 at a bottom portion.

The pouch 200 is formed into a bag shape with a peripheral seal portion 215 formed by thermally welding, at predetermined portions, a front surface side film 201, a rear surface side film 202, and a bottom film 203 in state of being folded in two and sandwiched between the front surface side film 201 and the rear surface side film 202 overlapped.

The peripheral seal portion 215 includes a top seal portion 216 formed by thermally bonding upper edges of the overlapped front surface side film 201 and the rear surface side film 202, side seal portions 217, 217 formed by thermally bonding both left and right side edges of the front surface side film 201 and the rear surface side film 202, and a bottom seal portion 218 formed by thermally bonding folded pieces 204, 204 of the bottom film 203 and bottom end side portions of the front surface side film 201 and the rear surface side film 202.

In the pouch 200 of the present embodiment, assuming that there is an inscribed ellipse E in contact with center positions of the inner edges of the peripheral seal portions 215 on two short sides, that is, the top seal portion 216 and the bottom seal portion 218, and center positions of the inner edges of the peripheral seal portions 215 on two long sides, that is, the left and right side seal portions 217, 217, the steam release seal portion 125 of the automatic steam release mechanism 120 is formed so that the circumference of the inscribed ellipse E is located within a width region of the seal separation start portion P in the vicinity of a corner portion corresponding to the four corners of the pouch 200. This inscribed ellipse E has ellipticity, which is the ratio of the minor axis to the major axis, being 0.6 to 0.97, and has a center point matching the center point O of the accommodation portion 210. The automatic steam release mechanism 120 has the same configuration as that of the pouch 100 according to the first embodiment.

Also in the pouch 200 according to the second embodiment, for the sake of improving the steam release performance, the steam release seal portion 125 is preferably formed so that the initial breaking point Q, which is the outer edge of the seal separation start portion P, is in contact with the circumference of the inscribed ellipse E.

The embodiment of the disclosure has been described in detail above, but the disclosure is not limited to the embodiment described above, and various design changes can be made without departing from the disclosure described in the claim.

For example, the steam release seal portion need not be provided continuous with the peripheral seal portion, and may be provided independently from and on the inner side of the outer peripheral seal portion. In addition, the steam release seal portion may be formed in another shape such as a rectangular annular shape, and may have appropriately selected dimensions.

Further, when the steam exit portion is formed as a hole, the opening shape of the hole need not be elliptical and may be any shape such as circular, oval, triangular, quadrangular, trapezoidal, or a rounded triangle, and may have appropriately selected dimensions. Further, the steam exit portion may be formed as a slit, and the shape of the slit may be any shape such as a semicircular shape, an arc shape, an irregular shape, or a linear shape, and may have appropriately selected dimensions.

EXAMPLES

The disclosure is further described by the following examples, which are not intended to limit the disclosure.

Example 1

With reference to the configuration illustrated in FIGS. 1 to 3, a microwavable pouch according to the disclosure (hereinafter, referred to as "pouch 1") was produced in such a manner that the steam release seal portion was formed with the outer edge of the seal separation start portion being in contact with the circumference of the inscribed ellipse in contact with the centers of the inner edges of sides of the peripheral seal portion of the pouch.

The steam release seal portion was formed at a position where an angle θ formed by a straight line connecting the center point of the accommodation portion and the center position of the inner edge of the top seal portion and a straight line connecting the center point of the accommodation portion and the outer edge of the seal separation start portion was 48°, and the distance L from the center point of the accommodation portion to the initial breaking point, which was the outer edge of the seal separation start portion, was 68 mm.

The steam release seal portion was formed in a semi-annular shape having an inner diameter of 11 mm and an outer diameter of 18 mm. The steam release seal portion had a seal strength equal to the seal strength of the peripheral seal portion at room temperature. Further, the peripheral seal portion had a width of 6 mm.

The pouch 1 described above was filled with 150 g of water, and the presence or absence of deformation of a pouch corner portion where the steam release seal portion was formed was visually observed.

Further, the pouch 1 filled with the content was heated in a microwave oven with a rated power of 600 W, and the steaming state was examined. A pouch with no retraction of the peripheral seal portion or bag breakage was evaluated as "Good", a pouch with retraction of the peripheral seal portion and without bag breakage was evaluated as "Passable", and a pouch with bag breakage was evaluated as "Poor".

The results are shown in Table 1 below.

Example 2 to Example 9

Eight types of microwavable pouches (hereinafter, referred to as "pouch 2" to "pouch 9") having the same configuration as that of pouch 1 produced in Example 1 were produced, except that one or both of the outer shape of the pouch and the position at which the steam release seal portion was formed were changed as in Table 1 below.

For each of these eight types of pouches 2 to 9, the presence or absence of deformation of the pouch corner portion after the pouch was filled with content was visually observed and the steaming state during heating was examined by the same method as in Example 1. The results are shown in Table 1 below.

Comparative Example 1 to Comparative Example 6

Figure 6:
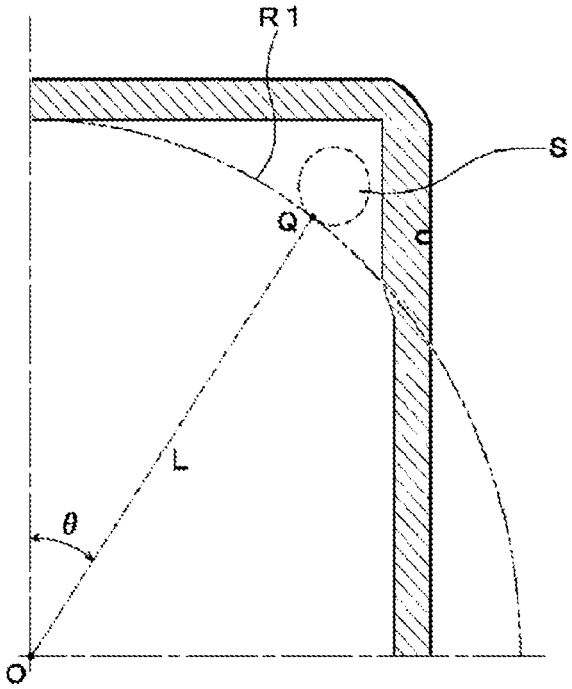
FIG. 6 is a diagram illustrating a position at which a steam release seal portion is formed in microwavable pouches produced according to Comparative Example 1 to Comparative Example 6.

As illustrated in FIG. 6, six types of comparative microwavable pouches (hereinafter, referred to as "comparative pouch 1" to "comparative pouch 6") having the same configuration as that of pouch 1 produced in Example 1 were produced, except that the steam release seal portion was formed with the initial breaking point Q being positioned on the circumference of an inscribed circle R1 in contact with the centers of the inner edges of the peripheral seal portions on the two short sides of the pouch, and one or both of the outer shape of the pouch and the position at which the steam release seal portion was formed were changed as in Table 2 below. In FIG. 6, the position at which the steam release seal portion was formed is schematically represented by a region S surrounded by a circular broken line.

For each of these six types of comparative pouches 1 to 6, the presence or absence of deformation of the pouch corner portion after the pouch was filled with the content was visually observed and the steaming state during heating was examined by the same method as in Example 1. The results are shown in Table 2 below.

Comparative Example 7 to Comparative Example 12

Figure 7:
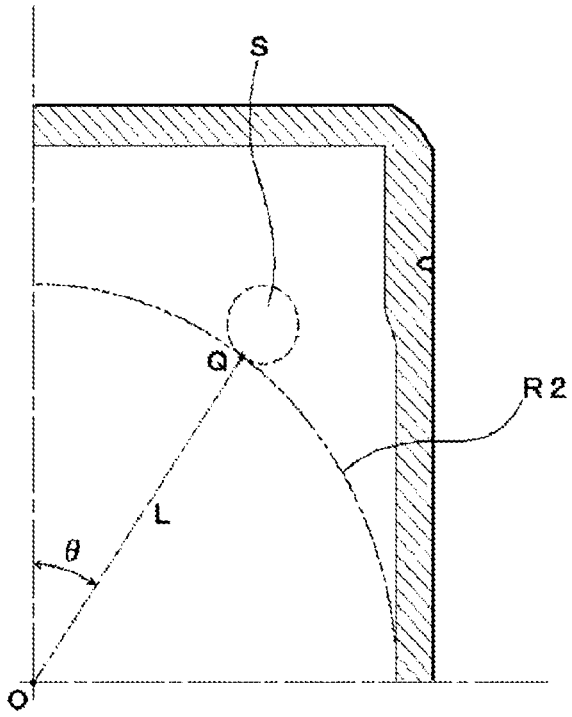
FIG. 7 is a diagram illustrating a position at which a steam release seal portion is formed in microwavable pouches produced according to Comparative Example 7 to Comparative Example 12.

As illustrated in FIG. 7, six types of comparative microwavable pouches (hereinafter, referred to as "comparative pouch 7" to "comparative pouch 12") having the same configuration as the pouch 1 produced in Example 1 were produced, except that the steam release seal portion was formed with the initial breaking point Q being positioned on or in the vicinity of the circumference of an inscribed circle R2 in contact with the centers of the inner edges of the peripheral seal portions on the two long sides of the pouch, and one or both of the outer shape of the pouch and the position at which the steam release seal portion was formed were changed as in Table 2 below. In FIG. 7, the position at which the steam release seal portion was formed is schematically represented by a region S surrounded by a circular broken line.

For each of these six types of comparative pouches 7 to 12, the presence or absence of deformation of the pouch corner portion after the pouch was filled with the content was visually observed and the steaming state during heating was examined by the same method as in Example 1. The results are shown in Table 2 below.

TABLE 1

| | Outer shape (short side × long side) | Ellipticity of inscribed ellipse | Steam release seal portion formed position | | Steaming state | Warpage of corner portion |
|---|---|---|---|---|---|---|
| | | | Angle θ | Distance L | | |
| Example 1 | 130 mm × | 0.71 | 48 | 68 | Good | None |
| Example 2 | 175 mm | | 28 | 73 | Good | None |
| Example 3 | | | 20 | 76 | Good | None |
| Example 4 | 120 mm × | 0.68 | 41 | 65 | Good | None |
| Example 5 | 175 mm | | 31 | 69 | Good | None |
| Example 6 | | | 22 | 74 | Good | None |
| Example 7 | 110 mm × | 0.62 | 40 | 61 | Good | None |
| Example 8 | 175 mm | | 28 | 68 | Good | None |
| Example 9 | | | 18 | 74 | Passable | None |

TABLE 2

| | Outer shape (short side × long side) | Steam release seal portion formed position | | Steaming state | Warpage of corner portion |
|---|---|---|---|---|---|
| | | Angle θ | Distance L | | |
| Comparative Example 1 | 130 mm × | 38 | 79 | Poor | None |
| Comparative Example 2 | 175 mm | 27 | | Poor | None |
| Comparative Example 3 | 120 mm × | 35 | 79 | Poor | None |

TABLE 2-continued

| | Outer shape (short side × long side) | Steam release seal portion formed position | | Steaming state | Warpage of corner portion |
|---|---|---|---|---|---|
| | | Angle θ | Distance L | | |
| Comparative Example 4 | 175 mm | 22 | | Poor | None |
| Comparative Example 5 | 110 mm × | 28 | 79 | Poor | None |
| Comparative Example 6 | 175 mm | 19 | | Poor | None |
| Comparative Example 7 | 130 mm × | 37 | 58 | Good | Yes |
| Comparative Example 8 | 175 mm | 27 | 59 | Good | Yes |
| Comparative Example 9 | 120 mm × | 43 | 54 | Good | Yes |
| Comparative Example 10 | 175 mm | 32 | | Good | Yes |
| Comparative Example 11 | 110 mm × | 43 | 49 | Good | Yes |
| Comparative Example 12 | 175 mm | 29 | | Good | Yes |

From the above results, it was confirmed that for the pouches 1 to 9 according to the disclosure, steam could be released from the steam release seal portion without the pouch corner portion warping after the pouch was filled with content and without the bag breaking during heating in the microwave oven. Furthermore, it was confirmed that with a configuration having an outer diameter shape with which the inscribed ellipse had small ellipticity, the steam release seal portion being formed at a position with a short distance between the center point of the accommodation portion and the outer edge of the seal separation start portion was beneficial in terms of safe steaming.

On the other hand, it was confirmed that for the comparative pouch 1 to the comparative pouch 6, while warpage of the pouch corner portion after the pouch was filled with the content could be suppressed, bag breakage occurs from the side seal portion during heating in the microwave oven.

Furthermore, it was confirmed that for the comparative pouch 7 to the comparative pouch 12, while steam could be released from the steam release seal portion without the bag breaking during heating in the microwave oven, significant warpage of the pouch corner portion after the pouch was filled with content occurs.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

The invention claimed is:

1. A microwavable pouch having a rectangular outer shape in plan view, and comprising an automatic steam release mechanism, wherein the automatic steam release mechanism includes a steam release portion and a steam release seal portion surrounding the steam release portion, with an inscribed ellipse being in contact with centers of inner edges of sides of a peripheral seal portion of the pouch, the steam release seal portion is formed so that a circumference of the inscribed ellipse is positioned in a width region of a seal separation start portion of the steam release seal portion closest to a center point of an accommodation portion or in a vicinity of the seal separation start portion, and the inscribed ellipse has a minor axis and a major axis, with a ratio of the minor axis to the major axis being 0.6 to 0.97.

2. The microwavable pouch according to claim 1, wherein the steam release seal portion is formed with an outer edge of the seal separation start portion being in contact with the circumference of the inscribed ellipse.

3. The microwavable pouch according to claim 1, wherein the steam release seal portion has a seal strength that is equal to a seal strength of the peripheral seal portion.

4. The microwavable pouch according to claim 1, wherein the steam release seal portion is provided continuous with the peripheral seal portion.

* * * * *